US005252093A

United States Patent [19]

Chien-Long

[11] Patent Number: 5,252,093

[45] Date of Patent: Oct. 12, 1993

[54] SIGNAL TRANSMITTING SOCKET

[76] Inventor: Lin Chien-Long, No. 12, Alley 8, Lane 33, An Ping Rd., Tainan City, Taiwan

[21] Appl. No.: 986,022

[22] Filed: Dec. 4, 1992

[51] Int. Cl.[5] ..... H01R 13/00

[52] U.S. Cl. ..... 439/702

[58] Field of Search ..... 439/669, 686, 701, 702, 439/707

[56] References Cited

U.S. PATENT DOCUMENTS 1,773,690 8/1930 Nero ..... 439/707

4,033,655 7/1977 Sewell ..... 439/702

*Primary Examiner*—Joseph H. McGlynn

*Attorney, Agent, or Firm*—Morton J. Rosenberg; David I. Klein

[57] ABSTRACT

A signal transmitting socket includes a cylindrical housing, a cylindrical shell adapted to be received within the housing and threadably secured thereto, and having a plurality of spaced grooves formed in its inner surface for receiving conducting plates and a circumferential groove formed in its inner surface; and a clamp having a circumferential rim adapted to securely engage the inner circumferential groove of the shell, and a plurality of spaced slots for receiving the lower ends of the conducting plates.

1 Claim, 6 Drawing Sheets

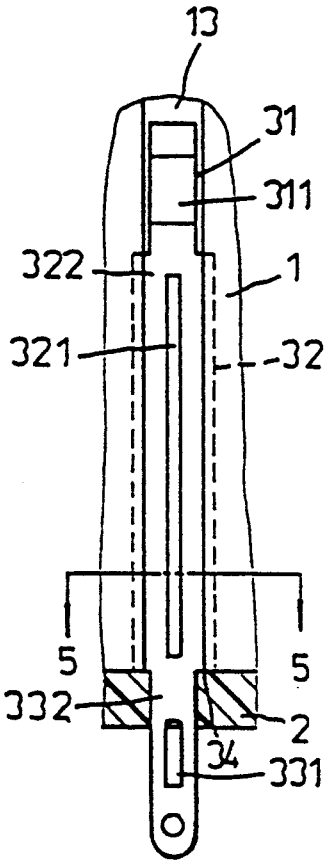
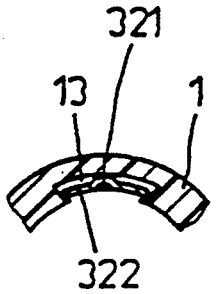
F I G. 5
F I G. 4

SIGNAL TRANSMITTING SOCKET

FIELD OF THE INVENTION

The invention is directed to a signal transmitting socket.

BACKGROUND OF THE INVENTION

Signal transmitting sockets are well-known in the prior art. As shown in FIGS. 6 and 7, a prior art signal transmitting socket essentially comprises a metal plated cylindrical shell A1 having a passage along its axis adapted to receive a cap A3. Cap A3 is provided with threads A31 on the upper outer cylindrical wall and has a cylindrical barrel A2 with an outer diameter slightly smaller than the inner diameter of the shell A1 for allowing the cylindrical barrel A2 of the cap A3 to be received within the shell A1. The prior art signal transmitting socket further includes a housing F adapted to receive the shell A1 therein. The upper end of the housing F is provided with an upper open end, and a tapered, closed lower end, which has a smaller diameter than the upper open end of the housing F. A mounting B disposed within the barrel A2 includes two identical semi-circular members, each of which has two slots B3 and B4 adapted to receive two conducting plates C and D. The lower ends of the semi-circular members B3 and B4 are provided with a notch B2 adapted to receive the top portion of a wire clip E. The conducting plate D has an insulating cover D1.

The prior art signal transmitting socket shown in FIGS. 6 and 7 is susceptible to having the metal plated portion of the cup A3 scratched, thereby losing its ability to accurately transmit signals. Furthermore, the insulating cover D1 becomes torn after use of the device.

SUMMARY OF THE INVENTION

An object of the present invention is to provide a signal transmitting socket which is made of a plastic protective outer shell that protects all components of the signal transmitting socket from scratches.

Another object of the present invention is to provide a signal transmitting device which uses fewer components than the prior art signal transmitting sockets, thereby minimizing cost as well as possible malfunctions.

A further object of the present invention is to provide a signal transmitting device which is easy to assemble.

These and other objects of the present invention will become apparent to those skilled in the art upon reading and understanding of the detailed description of the invention as set forth below.

BRIEF DESCRIPTION OF THE DRAWINGS

FIG. 4 is a side elevational view taken along Line A—A of FIG. 3A;

FIG. 5 is a top sectional view taken along Line B—B of FIG. 4;

DETAILED DESCRIPTION OF THE DRAWINGS

Figures 1A, 1B:
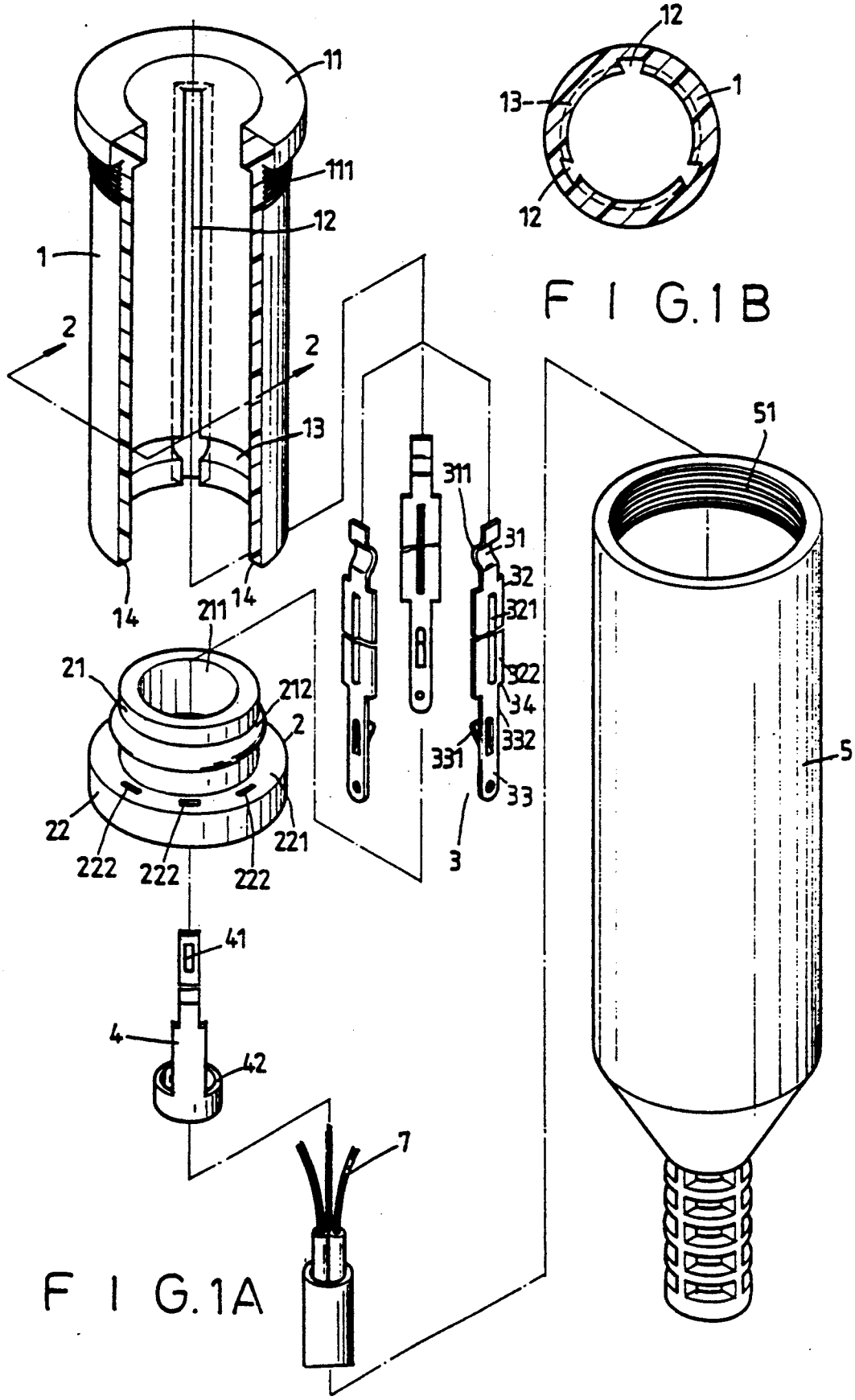
FIG. 1A is an exploded view of the present invention.
FIG. 1B is a top sectional view taken along Line X—X of FIG. 1A.
Figure 2:
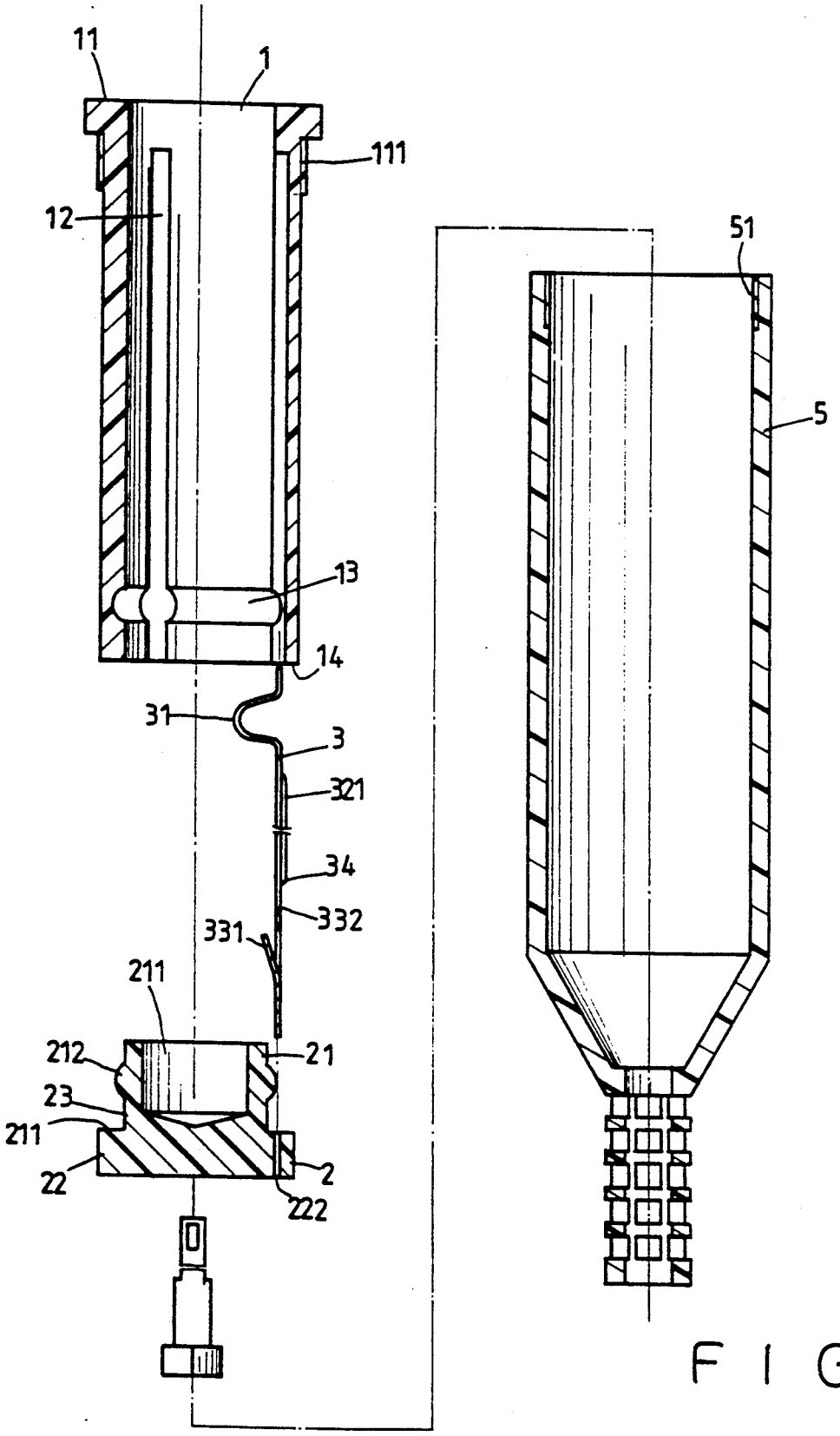
FIG. 2 is a plan fragmentary view of FIG. 1A, partially sectioned.

Referring to the Drawings, wherein the drawings are for the purposes of illustrating a preferred embodiment of the invention only, and not for the purposes of limiting the same, a signal transmitting socket in according with the present invention is shown in FIGS. 1A-5, and comprises a cylindrical shell 1, a cylindrical clamp 2, a plurality of conducting plates 3, a wire terminal 4, and a cylindrical housing 5. The cylindrical shell 1 includes an axial bore, a ledge 11 formed at the upper end of the shell 1, male threads 111 formed immediately under the ledge 11, a plurality of spaced, longitudinally extending dovetail-shaped grooves 12 formed on the inner wall of the shell 1, a groove 13 circumferentially extending around the inner lower portion of the shell 1.

The cylindrical clamp 2 is adapted to be connected to the shell 1 and has a lower portion 22, and an upper portion 21 having a diameter smaller than the diameter of the lower portion 22. The upper, reduced diameter portion 21 is provided with an enlarged circumferentially extending rim 212 which is adapted to be inserted into the groove 13 of the shell 1 so as to secure firmly the clamp 2 to the shell 1. The lower portion 22 of the clamp 2 is provided with a contacting surface 221 which abuts the lower surface 14 of the shell 1, and a plurality of slots 222 formed in the contacting surface 221. The spacing of the slots 222 of clamp 2 corresponds with the spacing of the dovetail shaped grooves 12 of the shell 1, and are adapted to receive conducting plates 3 mounted in the dovetail shaped grooves 12.

Each conducting plate 3 includes a contacting section 31 having a contact surface 311, a reinforcing section 32 having an arcuate shaped surface 322 with shoulders 34 and a reinforcing rib 321 provided on the arcuate shaped surface 322, and a clip section 33 having an elastic lug 331 protruding outwardly therefrom.

The wire terminal 4 includes a ring 42 through which a wire 7 is inserted and secured therein, and an elastic lug 41 extending upwardly from the ring 42.

The cylindrical housing 5 has a larger inner diameter than the outer diameter of the cylindrical shell 1 and is adapted to receive the shell 1 therein. The housing 5 includes an upper, open end, threads 51 extending around the upper, inner surface of the housing 5 for threadably mating or engaging with the threads 111 of the shell 1, and a tapered lower portion having a reduced diameter for receiving the wire 7, which is inserted therethrough.

Figure 3B:
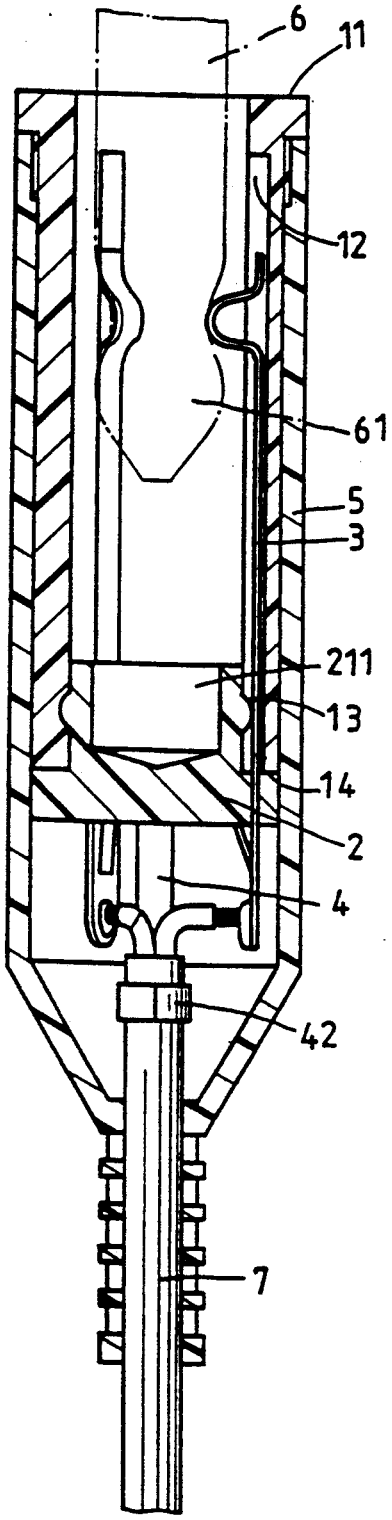
FIG. 3B is a further side elevational view, partially sectioned, showing the signal transmitting plug being fully inserted into the present invention.
Figure 3A:
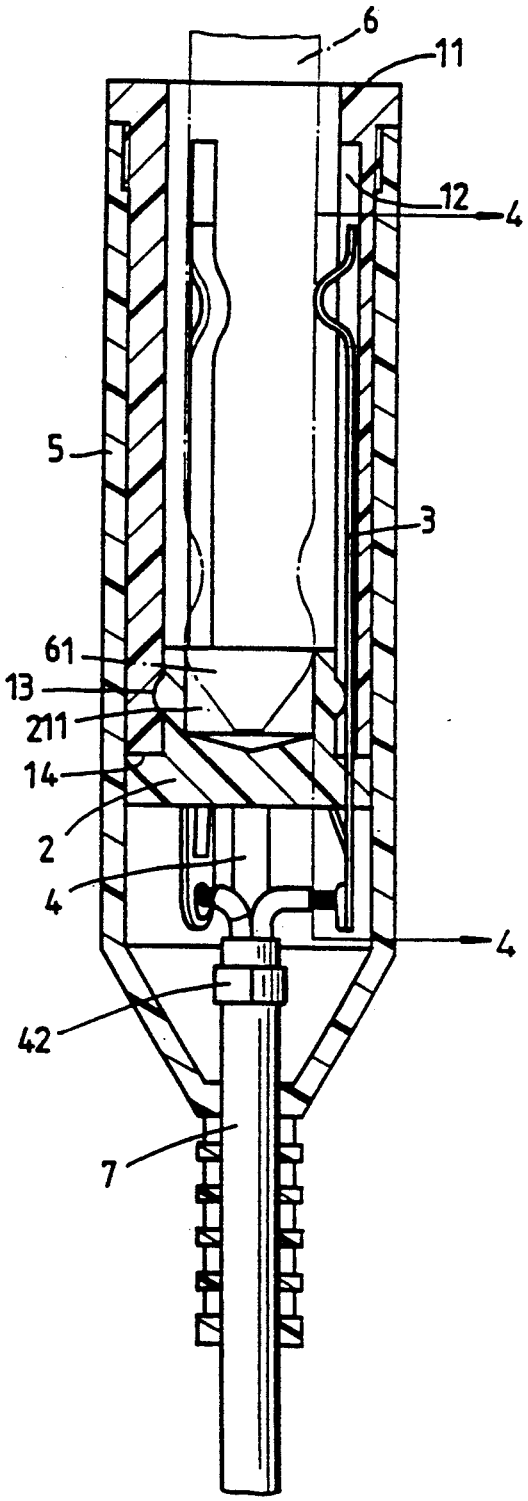
FIG. 3 is a side elevational view, partially sectioned, showing a signal transmitting plug being partially inserted into the present invention.
Figure 6:
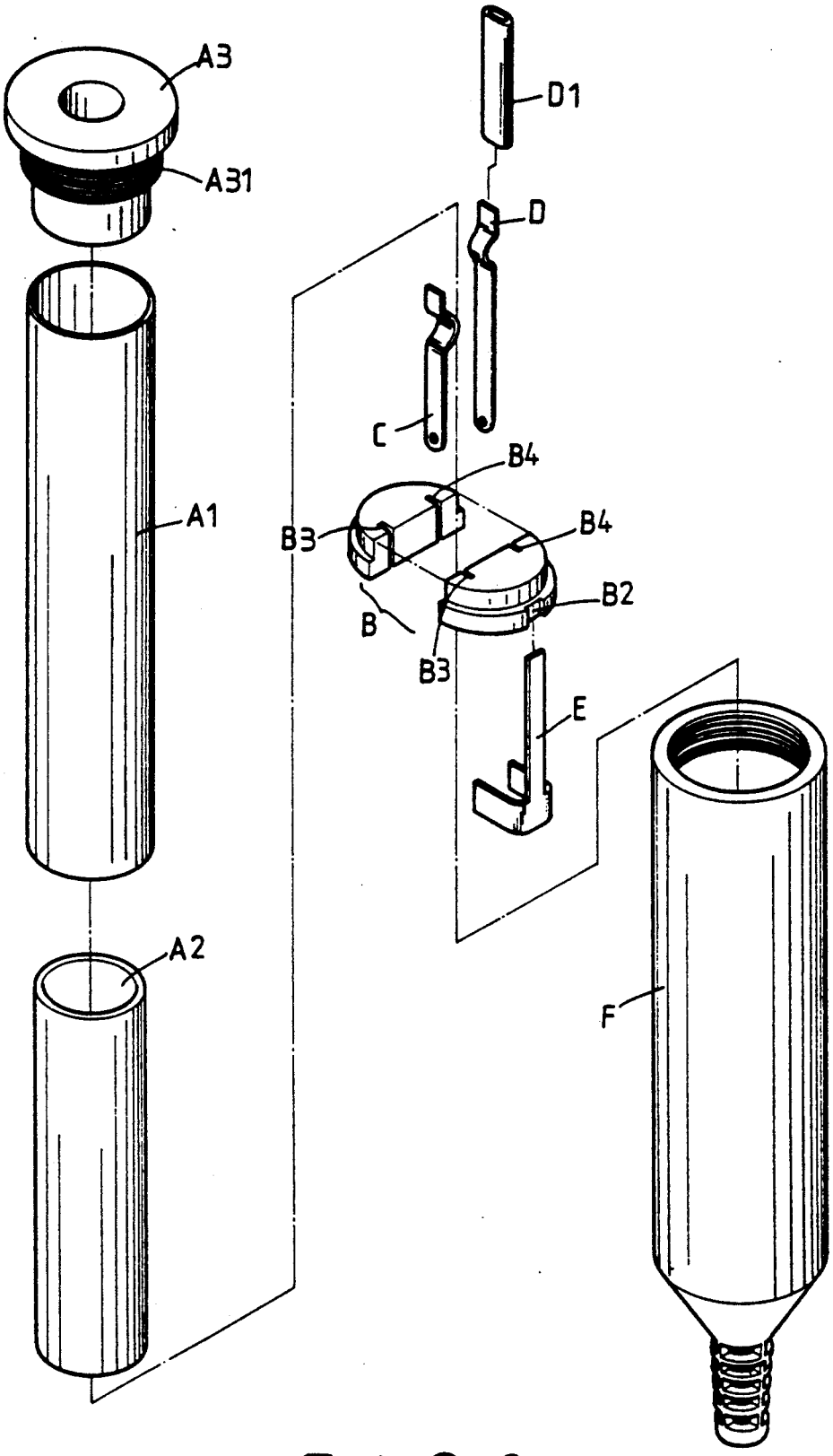
FIG. 6 PRIOR ART
FIG. 6 is an exploded view of a prior art signal transmitting device.
Figure 7:
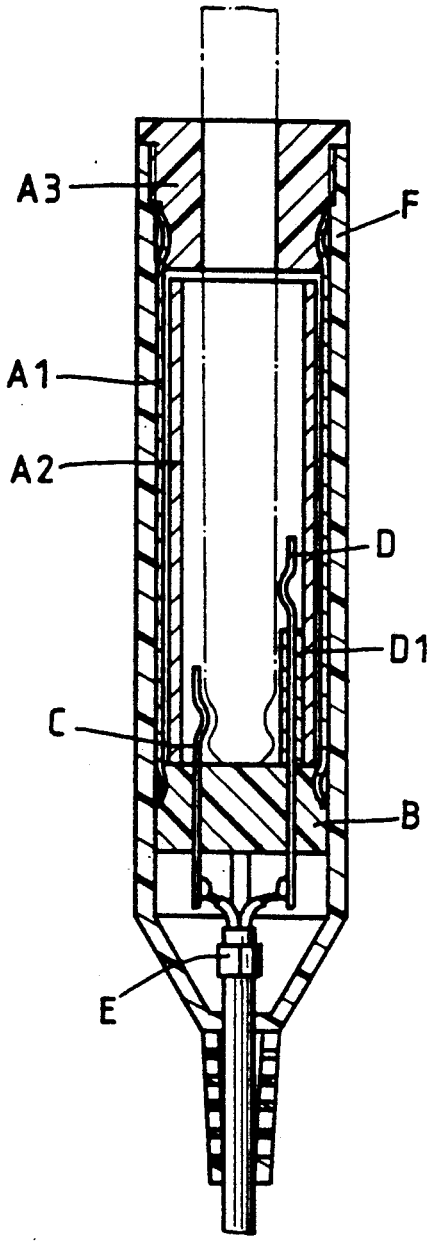
FIG. 7 PRIOR ART
FIG. 7 is an elevational view of FIG. 6.

When assembling the signal transmitting socket of the present invention, each conducting plate 3 is positioned so that each contacting surface 31 faces inwardly. The clip section 33 is inserted into a slot 222 of the clamp 2 until the elastic lug 331 engages the underside of the contacting surface 221. The upper end 21 of the clamp 2 is inserted into the lower end of the shell 1 until the circumferential rim 212 engages the circumferential groove 13 of shell 1 and the contacting surface 221 abuts the lower end 14 of the shell 1. The reinforcing ribs 321 of the conducting plates 3 are received within the dovetail shaped grooves 12 of shell 1. The wire terminal 4 is inserted into one of the slots 222 until the lug 41 is held firmly therein. The shell 1 is inserted into the housing 5 through the upper, open end of the housing. Threads 111 of the shell 1 threadably mate with threads 51 of the housing 5 until the ledge 11 abuts the upper, open end of the housing 5, as shown in FIGS. 3A and 3B.

FIGS. 4 and 5 show the relationship between the conducting plate 3 and the dovetail shaped groove 12 of the shell 1.

I claim:

1. A signal transmitting socket comprising:

a cylindrical shell having upper and lower open ends, an axial bore, a plurality of spaced dovetail shaped grooves formed in an inner surface of said shell, a circumferential groove formed in said inner surface of said shell, a ledge extending outwardly from said upper open end of said shell, and threads formed within an upper exterior surface of said shell;

a cylindrical clamp having an upper end adapted to be received within said lower open end of said shell, a circumferential rim provided on said upper end of said clamp for engaging said circumferential groove of said shell, a lower end adapted to abut said open end of said shell, and a plurality of slots formed in said lower end of said clamp, said plurality of slots being spaced to correspond to said dovetail shaped grooves of said housing;

a plurality of conducting plates, each conducting plate having an arcuate shaped body adapted to be received within a dovetail shaped groove of said shell, and a lower end having means to lockingly secure said conducting plate within at least one slot formed within said clamp; and, a cylindrical housing adapted to receive said shell, said clamp and said conducting plates therein, said cylindrical housing having threads formed within an upper outer surface for threadably engaging said threads of said shell.

* * * * *